United States Patent [19]

Hughes

[11] 4,199,306

[45] Apr. 22, 1980

[54] METHOD AND APPARATUS FOR COMPRESSING GAS

[76] Inventor: Michael Q. Hughes, 5821 Lisa La., Austell, Ga. 30001

[21] Appl. No.: 919,125

[22] Filed: Jun. 26, 1978

[51] Int. Cl.[2] ..... F04B 23/06

[52] U.S. Cl. ..... 417/458; 417/502; 417/503; 417/504

[58] Field of Search ..... 417/502, 503, 504, 243, 417/458; 137/512.1; 123/142, 198 D

[56] References Cited

U.S. PATENT DOCUMENTS

| | | | |
|---|---|---|---|
| 1,840,265 | 1/1932 | Spohrer | 417/243 |
| 2,030,759 | 2/1936 | Neal | 417/458 X |
| 2,678,541 | 5/1954 | Shoen | 417/458 X |
| 3,347,264 | 10/1967 | Bunn et al. | 137/512.1 |
| 3,829,253 | 8/1974 | Bunn et al. | 417/504 |
| 4,065,237 | 12/1977 | Webb | 417/503 |

FOREIGN PATENT DOCUMENTS

| | | | |
|---|---|---|---|
| 1114239 | 4/1956 | France | 417/243 |
| 1382117 | 11/1964 | France | 137/512.1 |

*Primary Examiner*—Richard E. Gluck
*Attorney, Agent, or Firm*—James B. Middleton

[57] ABSTRACT

A method and apparatus for pumping combustible gases at high pressure without raising the gas to its combustion temperature, the apparatus including a piston-type pump having an intake chamber communicating with a cylinder through intake valves, a discharge chamber communicating with the cylinder through discharge valves, the intake chamber and the discharge chamber having cooling means therearound for cooling gas in the chambers, the valving being such that gas must pass entirely through the intake chamber for maximum cooling on intake, and gas must pass entirely through the discharge chamber on discharge for maximum cooling on discharge, some gas being held in the discharge chamber during compression of the gas for maximum cooling.

3 Claims, 12 Drawing Figures

Fig. 1
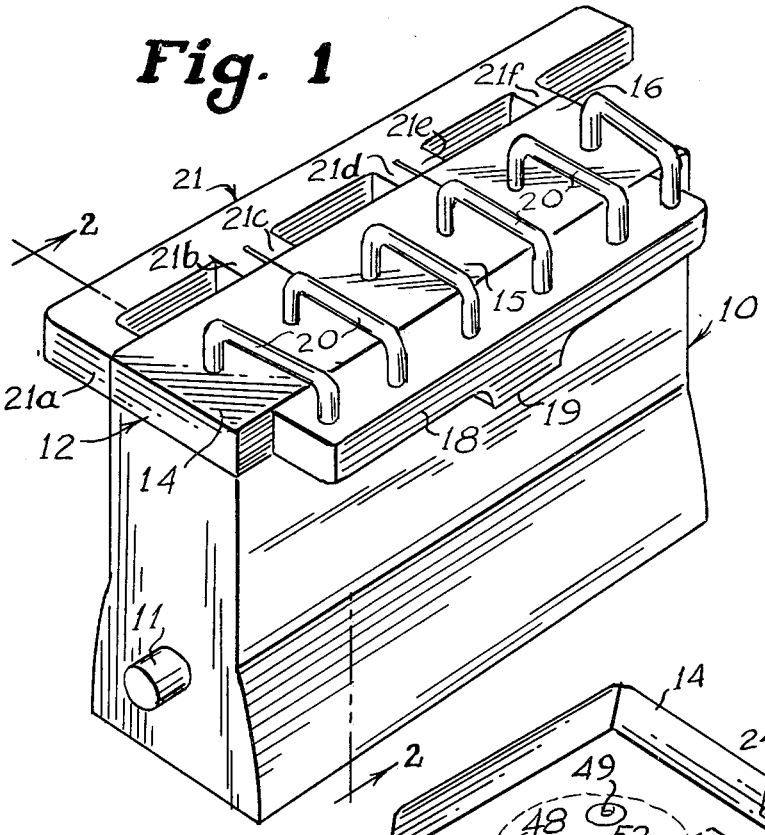
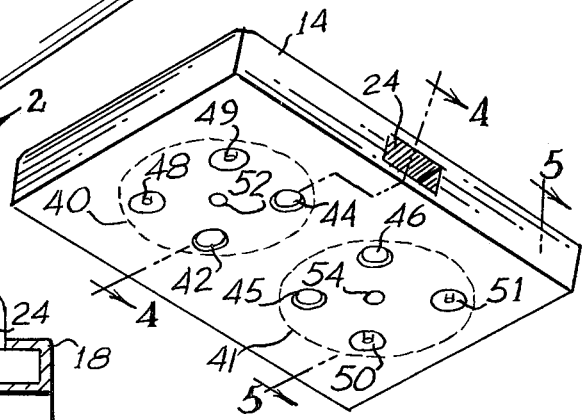
Fig. 3
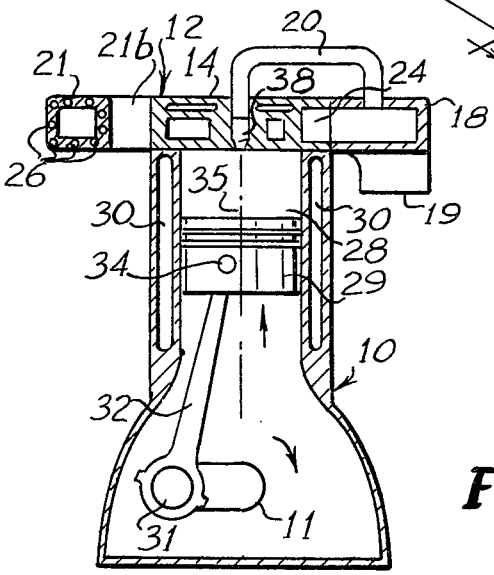
Fig. 2

METHOD AND APPARATUS FOR COMPRESSING GAS

This invention relates generally to the compression of gases, and is more particularly concerned with a method and apparatus for compressing a combustible gas to a high degree without allowing the gas to reach its combustion temperature.

It is frequently necessary to compress a gas to a great extent, for example to store a large quantity of gas in a tank or the like, or to urge a significant quantity of gas through a pipeline. In such compression, it is well understood that the temperature of the gas will rise considerably unless large amounts of heat are removed as the gas is compressed. Failure to remove a sufficient quantity of heat will allow the temperature of the compressed gas to rise very quickly so there will be an imminent danger of combustion of the gas.

For a compressor to have commercial utility in the compression of gas, the volume of the gas handled in a given period of time must be rather high. While a substantially conventional piston-type pump can handle a large volume of gas, raising the pressure as high as one might desire, it has been difficult heretofore to remove enough heat from the gas to maintain the gas below combustion temperature. While one might solve the heat problem by slowing operation of the pump, if the pump is operated slowly enough to allow removal of the heat by conventional means, the production of the pump becomes so low as to be commercially unacceptable. Other forms of pumps have therefore been used to pump combustible gases, and several forms of pump have met with commercial success; however, the prior art pumps for pumping combustible gases are excessively large and expensive both to purchase and to maintain, and the pressures that can be reached with the prior art pumps is limited. Additionally, since the prior art pumps are generally not positive displacement pumps, a large amount of power is usually required to operate the pumps.

The present invention overcomes the above mentioned and other difficulties with the prior art pumps by providing a piston-type pump for pumping combustible gases, the pump including at least one cooling chamber through which the gas passes. Means are provided to assure that gas, in its passage through the cooling chamber, is delayed sufficiently to effect the desired cooling of the gas. In one form of the invention there is a first chamber to be traversed by the gas on entering the pump cylinder, and a second chamber to be traversed by the gas on exiting from the pump cylinder. Additionally, if an even lower temperature is desired when the gas leaves the pump, the discharge manifold may include cooling means. The method of the present invention includes the steps of compressing gas in the cylinder, while a portion of the total charge of gas is in a cooling chamber, and discharging both the gas in the cylinder and the gas in the cooling chamber simultaneously so the gas mixes to yield an acceptable temperature. The method may also include passing the gas through an intake chamber for preliminary cooling.

These and other features and advantages of the present invention will become apparent from consideration of the following specification when taken in conjunction with the accompanying drawing in which:

FIG. 1 is a perspective view of one form of pump made in accordance with the present invention;

FIG. 2 is a cross-sectional view taken substantially along the line 2—2 in FIG. 1;

FIG. 3 is a perspective view of one of the heads of the pump shown in FIG. 1 of the drawing, and showing the valve ports for two of the cylinders;

Figure 4:
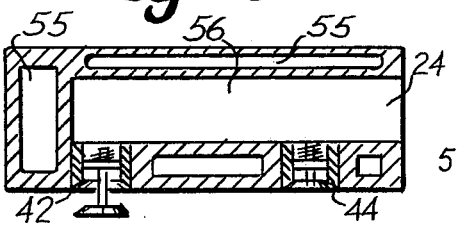
FIG. 4 is a cross-sectional view taken substantially along the line 4—4 in FIG. 3.

Referring now more particularly to the drawing, and to that embodiment of the invention here chosen by way of illustration, it will be seen that the pump as illustrated in FIG. 1 of the drawing includes a generally conventional cylinder block 10 having a crankshaft 11 extending therefrom. It will be understood that the cylinder block 10 would include a conventional oil pump for lubricating the pump itself, and drive means therefor, the drive conventionally being through appropriate gearing or the like from the crankshaft 11. Such features are well known to those skilled in the art, and they are not here shown since they are not necessary for a full understanding of the present invention.

The upper surface of the cylinder block 10 receives a plurality of heads 12; and, while many different arrangements of heads may be used, the arrangement here shown includes a separate head for each of two adjacent separate cylinders. As a result, the heads 12 shown in FIG. 1 comprise three separate plates, or heads, designated at 14, 15 and 16.

As will be discussed in more detail hereinafter, each of the heads 14, 15 and 16 includes a single intake port which branches internally to provide the intake for the two separate cylinders covered by the one head. The intake port on each of the three heads 14, 15 and 16 is covered by a single intake manifold designated at 18 which has an intake opening 19. The intake manifold 18 also has, in communication therewith, a plurality of pipes 20 which lead from the pressure release plug in the head 12 to the intake manifold. This construction will be discussed in more detail hereinafter.

On the opposite side of the head 12, it will be seen that there is a discharge manifold 21. The heads 14, 15 and 16 are provided with separate outlets for the discharge side, so the discharge manifold 21 must have (in the pump illustrated) six branches for connection to the heads 12.

Attention is next directed to FIG. 2 of the drawing where the arrangement with respect to one typical cylinder is shown. It will be seen that the inlet 19 of the intake manifold 18 communicates with the interior of the intake manifold proper, and the intake manifold communicates with the intake port 24 of the head 14. It will be understood that the cross-sectional view shown in FIG. 2 of the drawings is taken substantially through the centerline of the cylinder, so that neither the intake nor the discharge valves are shown. It will, however, be seen that the discharge manifold 21 is shown having a branch 21b which is connected to the head 14 and to the manifold per se 21. The manifold 21 is here shown as including a plurality of coolant passages 26 as a means for cooling the discharge manifold. It will of course be understood by those skilled in the art that many different forms of cooling apparatus could be used to cool the discharge manifold, but the one here shown is conventional and will be readily understood.

The cylinder block 10 is shown as having a cylinder 28 with a piston 29 reciprocable therein. At each side of the cylinder 28, the wall of the cylinder block 10 is shown as including a coolant jacket 30 as is conventional for engines using the type of cylinder block shown. The crankshaft 11 is provided with a plurality of throws, one of which is shown at 31, the throw 31 having a connecting rod 32 connected with appropriate bearings (not shown) and to the wrist pin 34 of the piston 29.

It will be understood that, when an arrangement such as that here shown is used as an engine rather than as a pump, the wrist pin 34 is located along a diameter of the piston 29. Because of the difference in the forces involved in using the device as a pump rather than as an engine, it should be noted that the centerline 35 represents the centerline of the cylinder 28 and of the piston 29; however, the wrist pin 34 is slightly offset from the center line 35. In the position shown, the piston 29 is moving up in the cylinder 28. Due to the angle of the connecting rod 32, it will be understood that there will be a component of force tending to urge the piston 29 to the right as viewed in FIG. 2. This forcing of the piston 29 to the right will assist in stabilizing the right-hand side of the piston, and the moving of the wrist pin 34 to the left balances the forces involved so that the piston 29 will ride smoothly through the cylinder even though under pressure.

Another feature of the invention is also shown in FIG. 2 of the drawing where it will be seen that there is a substantially conventional blow-out plug 38. Such blow-out plugs are well known in the art, and are frequently used in pumps or other pressurized devices and vessels. Since the pump of the present invention is designed primarily for use in pumping combustible gases such as methane, butane and the like, it would be undesirable to release such material to the atmosphere, both from the standpoint of pollution of the atmosphere and from the standpoint of the loss of the gas. To prevent loss, even in the event of excessive pressures that would cause the plug 38 to blow out, the port carrying the blow-out plug 38 is connected by a pipe 20 to the intake manifold 18.

With this arrangement, it will be seen that if the plug 38 blows out due to excessive pressure within the cylinder 28, the interior of the cylinder 28 would be connected through the port carrying the blow-out plug 38 and the pipe 20 to the interior of the intake manifold 18. As a result, the piston 29 can continue to reciprocate within the cylinder, and the pump can continue to operate without loss of the medium being pumped. It will of course be understood that the cylinder 28 would no longer pump the fluid, but loss of the blow-out plug 38 would not require immediate shut-down of the entire pump.

Attention is next directed to FIG. 3 of the drawing which shows one head of the plurality of heads 12, the plate in FIG. 3 being designated as 14, though it will be understood that the plates 14, 15 and 16 are all substantially identical.

In FIG. 3, since the head 14 covers two cylinders, the areas of the head 14 that would cover the cylinders is shown in broken lines at 40 and 41. There are two intake valves 42 and 44 within the area 40, and there are two intake valves 45 and 46 within the area 41. The valves 42, 44, 45 and 46 all communicate with the intake port 24.

Also, within the area 40, there are two discharge valves 48 and 49, and within the area 41 there are two discharge valves 50 and 51. As was previously stated, the discharge valves for each cylinder connect to a separate discharge port leading from the head 41, though these discharge ports are not shown in FIG. 3.

Substantially centrally of the four valves in each of the areas 40 and 41, there is a central port 52 and 54 which are the ports to receive the blow-out plugs previously discussed.

With this arrangement in mind, attention is directed to FIG. 4 of the drawing which is a cross-sectional view taken through the two intake valves 42 and 44 and through the intake port 24 so that the entire intake passageway for one cylinder is shown in one drawing. It should be realized that, FIG. 4 being a cross-sectional view through the head 14, the substantially conventional cooling jacket is shown. The cooling jacket is here represented simply by coolant areas designated at 55.

The two intake valves 42 and 44 are shown as check valves that are oriented to allow fluid flow in one direction, with a spring to return the valve to the closed position. The intake valves extend from an intake chamber 56 within the head 14 through the lower surface of the head 14 as shown in FIG. 3 of the drawing, to allow fluid to flow from the intake port 24, into the intake chamber 56, through the valves 42 and 44 and into a cylinder such as the cylinder 28 shown in FIG. 2 of the drawing.

Those skilled in the art will understand that numerous precise constructions of valves 42 and 44 can be utilized, the important features being the facts that they are check valves to allow fluid flow in only one direction, and that the valves have sufficient strength to withstand the pressures involved at the highest pressure for which the pump is designed. Additionally, the valves 42 and 44 should have a spring to resist opening of the valve, the spring being adjustable for some variation in the opening pressure. An adjustable feature is not shown in the drawing, and it is not necessary that the valves be variable after installation since the spring tension can be preset before the valves are installed. Nevertheless, it will appear later in this discussion that a difference in spring tension is important to the operation of the invention. Briefly however, it should be mentioned here that the valve 42 would have a spring pressure such that the valve 42 will open under less force than the valve 44.

Figure 5:
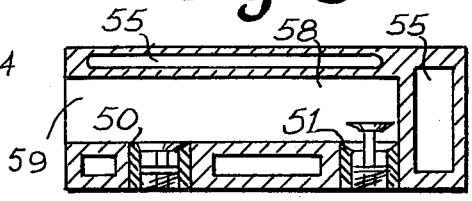
FIG. 5 is a cross-sectional view taken substantially along the line 5—5 in FIG. 3.

Attention is next directed to FIG. 5 which is a view similar to FIG. 4 but showing the discharge path of fluid from a cylinder. Since FIG. 5 also shows a portion of the head 14, it will be seen that the cooling jacket in FIG. 5 is also designated as having coolant chambers 55.

Looking at FIG. 5, it will be seen that the discharge path is very similar to the intake path shown in FIG. 4. The valves 50 and 51 connect the interior of a cylinder, such as the cylinder 28 shown in FIG. 2 of the drawing, to a discharge chamber 58, the discharge chamber 58 leading directly to the discharge port 59 where one of the branches of the discharge manifold 21 would be connected.

The valves 50 and 51 shown in FIG. 5 of the drawing are substantially identical to the valves 42 and 44 shown in FIG. 4 of the drawing except that the flow direction must be reversed, so the valves are reversed. In FIG. 5, the valve 51 would be set to open under less pressure than the valve 50. The reason for this arrangement will become apparent hereinafter.

The foregoing sets forth the construction of a pump made in accordance with the present invention, and the method of operation of the pump will now be described.

Figure 6A:
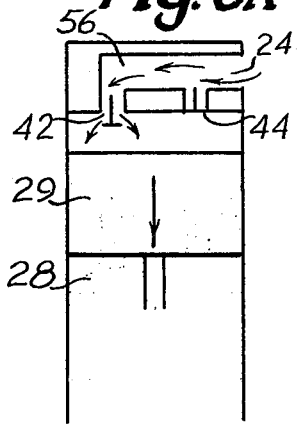
FIGS. 6A, 6B and 6C are schematic representations showing the operation of one cylinder of a pump constructed in accordance with the present invention, during an intake stroke.
Figure 6B:
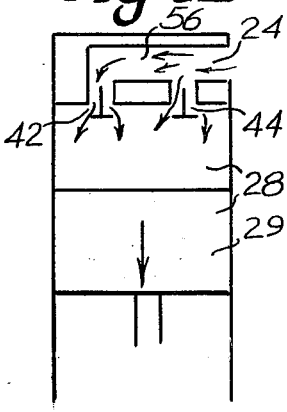
Figure 6C:
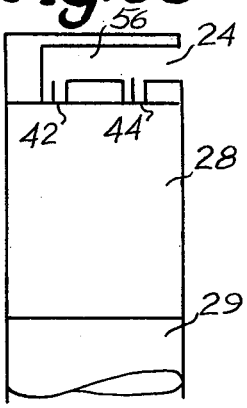

For a discussion of the operation of a pump in accordance with the present invention; attention is directed first to FIGS. 6A, 6B and 6C of the drawing which show, by way of illustration, the cylinder 28 with its piston 29. In FIG. 6A of the drawing, the piston 29 is shown after it has moved down to a very small extent, the piston continuing in its down stroke.

It will be remembered that the valve 42 was provided with spring tension such that the valve 42 will open with less pressure than the valve 44. As a result of this arrangement, when the piston 29 first starts down, the valve 42 will open while the valve 44 remains closed; so, gas entering from the intake port 24 must traverse the entire intake chamber 56, passing by the valve 44, to reach the valve 42 through which the gas can enter the cylinder 28. This assures that the intake chamber 56 will be filled with gas at the beginning of the intake stroke, and the first gas to enter must traverse the entire chamber 56, which assures maximum cooling of the gas because the gas is in contact with the cooled surfaces.

FIG. 6B of the drawing shows the cylinder 28 after the piston 29 has moved down somewhat more. It will be understood that the valve 42 does not provide a large enough opening to allow the pressures to balance between the intake port 24 and the interior of the cylinder 28 above the piston 29 as the piston 29 descends. Due to this fact, there would tend to be a partial vacuum within the cylinder 28 above the piston 29 so that a large enough pressure differential is created to open the valve 44. Once the valve 44 is opened, gas will flow from the intake port 24 through both the valve 42 and the valve 44. Even with both valves open, however, a large quantity of the gas entering the cylinder will traverse the entire intake chamber 56, and the rest of the gas will pass through some portion of the chamber 56; therefore, all of the gas entering the cylinder 28 above the piston 29 will be substantially cooled by its passage through the chamber 56. It will therefore be understood that the intake chamber 56 can also be considered as a first cooling chamber.

FIG. 6C of the drawing shows the piston 29 within the cylinder 28 with the piston 29 at its bottom-dead-center. It will be readily understood by those skilled in the art that, when the piston 29 reaches its bottom-dead-center, the pressure at the intake port 24 and the pressure within the cylinder 28 will be balanced to yield a zero differential pressure. As a result of this condition, the springs on the valves 42 and 44 will cause the valves to close as shown in FIG. 6C. This completes the intake stroke, it being understood that the cylinder 28 is now filled with gas which has been cooled as it entered.

Figure 7A:
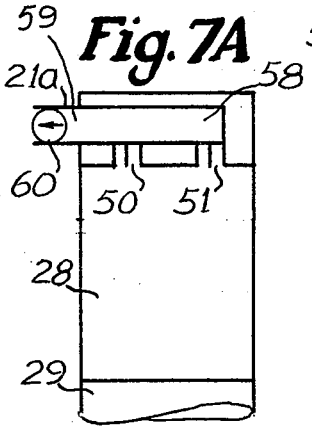
FIGS. 7A, 7B and 7C are views similar to FIGS. 6A, 6B and 6C but showing the discharge stroke of the cylinder; and, FIG. 8 is a schematic view showing the intake and discharge passageways through a pump constructed in accordance with the present invention, and showing the location of the various valves and the cylinders of the pump.
Figure 7B:
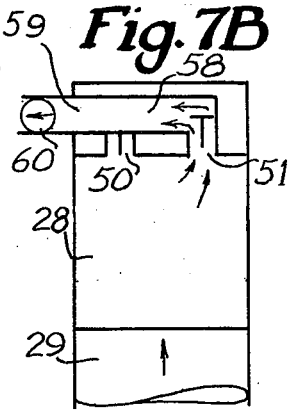
Figure 7C:
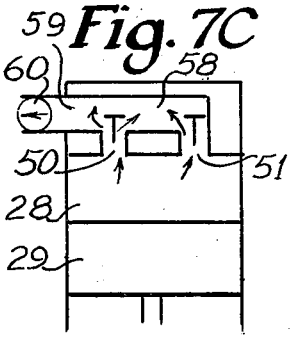

Attention is next directed to FIGS. 7A, 7B and 7C of the drawing which are similar to FIGS. 6A, 6B and 6C but show the discharge stroke of the cylinder of the pump.

Referring first to FIG. 7A of the drawing, it will be seen that the piston 29 is at its bottom-dead-center, and both the valve 50 and the valve 51 are closed. It will be remembered that the valve 51 has spring tension such that the valve 51 will open under less pressure than the valve 50. As a result, when the piston 29 first begins its upstroke, the valve 51 will open to allow gas to pass from the cylinder 28 to the discharge chamber 58. It will be seen that the gas must traverse the entire discharge chamber 58 to reach the exit, or discharge, port 59 so that, as occurred during the intake stroke, the chamber 58 is filled with gas and the first gas to exit must traverse the entire discharge chamber 58, thereby receiving maximum cooling.

As the piston continues its upward travel, the pressure increases due to the fact that the valve 51 does not provide a sufficient opening to maintain balanced pressures as the piston moves up. As a result, the valve 50 will open as shown in FIG. 7C of the drawing, and gas will pass through both the valve 51 and the valve 50 to pass from the cylinder 28 to the discharge chamber 58. Thus, the discharge chamber 58 can also be considered as a second cooling chamber.

It will be noted that there is a check valve 60 in the branch **21*a* of the discharge manifold 21, the check valve 60 being arranged to allow fluid flow from the cooling chamber 58 into the manifold 21. It will therefore be seen that the gas within the cylinder 28 is forced first through the valve 51 to traverse the cooling chamber 58; subsequently, when the pressure increases, the valve 50 will open so that gas passes from the cylinder 28 through both the valve 50 and the valve 51, through the cooling chamber 58, through the discharge port 59, through the check valve 60 and into the discharge manifold 21. Thus, the gas is cooled as it leaves the cylinder 28**.

Figure 8:
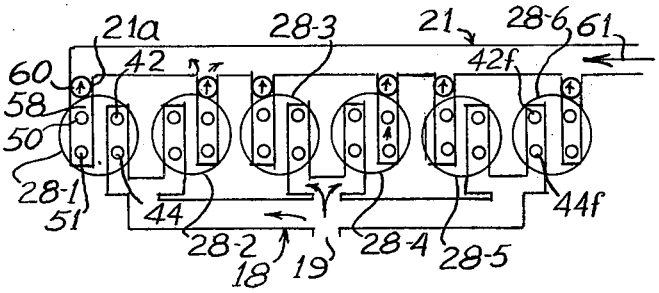

The foregoing has considered the operation of the pump from the standpoint of one single cylinder; however, the entire pump as contemplated by the present invention will include a plurality of cylinders, and for a discussion of a multi-cylinder pump, attention is directed to FIG. 8 of the drawing.

In FIG. 8, it will be seen that a six cylinder pump is represented, the six cylinders being designated at 28-1, 28-2, 28-3, 28-4, 28-5 and 28-6. The intake manifold 18 is represented schematically, the manifold 18 being connected to the intake port 24. Similarly, the discharge manifold 21 is represented along with the various branches **21*a*, 21*b*, 21*c*, 21*d*, 21 *e* and 21*f***.

It is contemplated that the timing of the pump will be such that the first cylinder will be the first to take in a charge of gas, and the down stroke of the piston in cylinder 28-1 has been described previously. It is clearly shown in FIG. 8 of the drawing that the incoming gas must traverse the entire cooling chamber 56 in order to reach the valve 42, which is the first to open. Before the cylinder 28-1 receives a full charge of gas, the piston in cylinder 28-6 will begin its downward motion causing valve **42*f* to open first, followed by valve 44*f*. This sequence will continue with cylinder number 2, followed by cylinder number 5, then cylinder number 3 and finally cylinder number 4**. For each of the cylinders, the intake stroke will be the same as previously described, the valve farther from the intake port being the first to open so that gas must traverse the entire first cooling chamber, thereby cooling the gas to a maximum extent and filling the cooling chamber with gas.

After the piston 29 has reached its bottom-dead-center, the piston will start up. The intake valves 42 and 44 are closed, and the first upward motion of the piston will cause the valve 51 to open. Further motion of the piston will cause the valve 50 to open. It will therefore be seen that the discharge valves are also arranged so that the valve farther from the discharge port is first to open, causing the gas to traverse the entire second cooling chamber 58 and to fill the cooling chamber 58 with gas before opening of the valve 50. It will also be seen that the gas will pass through the check valves 60 and into the discharge manifold 21.

As discussed in connection with the intake stroke, the discharge stroke of the cylinders will be timed in the order of 1-6-2-5-3-4. It will thus be understood by those skilled in the art that the timing of the various cylinders is such that the strokes are balanced to provide frequent input to the discharge manifold 21.

From the foregoing, it will be understood that the pump itself does not provide means for enclosing a cylinder to compress the gas within the cylinder; rather, the compression of the gas is provided by means of back-pressure through the manifold 21. This back-pressure is represented in FIG. 8 by an arrow 61. As a matter of practice, the back-pressure 61 is provided by whatever the pump is supplying. It may be that the pump is filling a tank with gas, so that when the tank is empty the back pressure 61 will be very low and the pump will do very little compression of the gas but will simply move the gas into the tank; however, when the tank becomes well filled, the pressure will naturally increase so that the back-pressure 61 will be substantially increased. The back-pressure 61, being a fluid pressure, will be exerted equally throughout the manifold 21 so that each of the cylinders will encounter the pressure 61 on the discharge stroke. It is by this means that the pump of the present invention compresses gas. Alternatively, it will be understood that the back pressure 61 may be from the resistance of a pipeline in the event the pump of the present invention is used to supply a pipeline.

Considering the back-pressure in the discharge manifold, it will be seen that the pressure will tend to hold the check valves 60 closed, so that the pump must overcome the back-pressure in order to open the check valve 60. This means that, after the discharge valves 50 and 51 open, and the piston 29 continues to move up, the gas in the cylinder is compressed in the area comprising the discharge chamber 58 and the cylinder 28 above the piston 29.

It is well known that, as a given quantity of gas at a given temperature is compressed to a smaller volume, the temperature rises. However, it will be seen that, with the present method and apparatus, a portion of the gas is rather static, and is located in the discharge chamber 58, so heat is being constantly removed from the gas. Thus, even though the gas located within the cylinder 28 may not be cooled as much as one might desire, once the check valve 60 opens, this warmer gas will flow into the discharge manifold 21 and be mixed with the cooler gas that was in the discharge chamber 58 to yield a sufficiently low resultant temperature.

From the foregoing it should now be understood by those skilled in the art that the pump of the present invention provides both an apparatus and a method for pumping a combustible gas to any desired pressure without raising the gas to a dangerously high temperature. It will be seen that, as the gas enters a cylinder, the gas is exposed to a first cooling chamber wherein the gas is delayed by being required to traverse the entire cooling chamber, thereby cooling the gas to a maximum extent and filling the cooling chamber with gas. The result is to place the gas within a cylinder with the gas at a minimum temperature. On the subsequent compression, or discharge, stroke of the pump, assuming there is sufficient back-pressure 61 to cause the discharge stroke of the cylinder to compress the gas, the gas is held within the second cooling chamber, and is then required to traverse the entire second cooling chamber for maximum cooling during discharge from the cylinder.

Though in many cases the cooling chambers within the heads of the pump will be sufficient, it may be desirable in some cases to provide a cooling jacket for the discharge manifold which will allow further cooling of the gas. This is especially advantageous in view of the method contemplated by the present invention wherein the discharge manifold will be under pressure due to the back-pressure 61.

Since the method and apparatus of the present invention utilize the back pressure of the line as the means for causing the pump to compress gas, the timing of the pump is somewhat important. However, the timing is important only in that there should be a discharge stroke at regular intervals to maintain maximum pressure. In the event the pump is used to supply a pipeline, those skilled in the art will realize that the pressure will dissipate in time if gas is not continually added to the line. Thus, the use of a piston-type pump is valuable because positive displacement is provided, and a stroke can be provided frequently enough to pack the line and maintain the desired pressure to achieve the commercially economical quantities.

It will of course be understood by those skilled in the art that the embodiment of the invention here chosen is by way of illustration only, and is meant to be in no way restrictive; therefore, numerous changes and modifications may be made, and the full use of equivalents resorted to without departing from the spirit or scope of the invention as defined by the appended claims.

I claim:

1. Apparatus for pumping a gas, said apparatus including a cylinder, a piston reciprocable within said cylinder, and means for causing said piston to reciprocate within said cylinder, intake means for placing a quantity of gas within said cylinder as said piston moves in one direction, a discharge chamber immediately adjacent to said cylinder, discharge valve means between said cylinder and said discharge chamber for providing selective communication between said cylinder and said discharge chamber, and cooling means for cooling said discharge chamber, said discharge valve means comprising a first discharge valve and a second discharge valve, a discharge port communicating with said discharge chamber at one side thereof, said first discharge valve being located at the opposite side of said discharge chamber from said discharge port, said second discharge valve being located on the same side of said discharge chamber as said discharge port, said first discharge valve being constructed to open under smaller pressure differential than said second discharge valve, a discharge manifold for receiving a gas from said discharge chamber, manifold valve means between said discharge chamber and said discharge manifold, said manifold valve means comprising a check valve oriented to allow fluid flow from said discharge chamber to said discharge manifold, an intake chamber immediately adjacent to said cylinder, intake valve means between said intake chamber and said cylinder for providing selective communication between said cylinder and said intake chamber, and cooling means for cooling said intake chamber, said intake valve means comprising a first intake valve and a second intake valve, an intake port communicating with said intake chamber at one side thereof, means for supplying gas to said intake port, said first intake valve being located at the opposite side of said intake chamber from said intake port, said second intake valve being located on the same side of said intake chamber as said intake port, said first intake valve being constructed to open under smaller pressure differential than said second intake valve.

2. Apparatus as claimed in claim 1, said apparatus including a plurality of said cylinders, said means for supplying gas to said intake port comprising an intake manifold communicating with said intake port for all of said plurality of cylinders, and all of said plurality of cylinders communicating with said discharge manifold.

3. Apparatus for pumping a gas, said apparatus including a cylinder, a piston reciprocable within said cylinder, and means for causing said piston to reciprocate within said cylinder, intake means for placing a quantity of gas within said cylinder as said piston moves in one direction, a discharge chamber immediately adjacent to said cylinder, discharge valve means between said cylinder and said discharge chamber for providing selective communication between said cylinder and said discharge chamber, and cooling means for cooling said discharge chamber, said discharge valve means comprising a first discharge valve and a second discharge valve, a discharge port communicating with said discharge chamber at one side thereof, said first discharge valve being located at the opposite side of said discharge chamber from said discharge port, said second discharge valve being located on the same side of said discharge chamber as said discharge port, said first discharge valve being constructed to open under smaller pressure differential than said second discharge valve, a discharge manifold for receiving gas from said cylinder, manifold valve means between said discharge manifold and said discharge chamber, said manifold valve means comprising a check valve oriented to allow fluid flow from said discharge chamber to said discharge manifold, an intake chamber adjacent to said cylinder, intake valve means between said intake chamber and said cylinder for providing selective communication between said cylinder and said intake chamber, cooling means for cooling said intake chamber, said intake valve means comprising a first intake valve and a second intake valve, an intake port communicating with said intake chamber at one side thereof, means for supplying gas to said intake port, said first intake valve being located at the opposite side of said intake chamber from said intake port, said second intake valve being located on the same side of said intake chamber as said intake port, said first intake valve being constructed to open under smaller pressure differential than said second intake valve, said apparatus further including a plurality of said cylinders, said means for supplying gas to said intake port comprising an intake manifold communicating with said intake port for all of said plurality of cylinders, and all of said plurality of cylinders communicating with said discharge manifold, each cylinder of said plurality of cylinders having a blow-out plug within a port in communication with said cylinder, and pipe means connecting said port with said intake manifold.

* * * * *